United States Patent [19]

Dennie

[11] Patent Number: 4,474,396

[45] Date of Patent: Oct. 2, 1984

[54] WOOD STOVE AND FIREPLACE LOG HANDLER

[76] Inventor: James T. Dennie, 2023 S. Oakland St., Arlington, Va. 22204

[21] Appl. No.: 386,042

[22] Filed: Jun. 7, 1982

[51] Int. Cl.[3] ..... A47J 49/00

[52] U.S. Cl. ..... 294/11; 294/103 R

[58] Field of Search ..... 294/9–11, 294/14, 16, 17, 19 R, 34, 62, 63 B, 50.9, 99 S, 103 R, 104

[56] References Cited

U.S. PATENT DOCUMENTS

| | | | |
|---|---|---|---|
| 195,186 | 9/1877 | Tyner | 294/103 R |
| 1,021,290 | 3/1912 | Althouse | 294/11 |
| 1,254,765 | 1/1918 | Binn | 294/11 |
| 1,497,542 | 6/1924 | Carlson | 294/11 |
| 1,597,281 | 8/1926 | Mills | 294/50.9 |
| 2,936,192 | 5/1960 | Lince | 294/16 |
| 4,176,871 | 12/1979 | Stover | 294/10 |
| 4,225,170 | 9/1980 | Flynn | 294/11 |
| 4,307,909 | 12/1981 | Yaworski | 294/11 |

*Primary Examiner*—Johnny D. Cherry

*Attorney, Agent, or Firm*—Zalkind & Shuster

[57] ABSTRACT

A log handling device is provided capable of picking up logs to be thrust end first into wood stoves or sideways into fireplaces. The invention contemplates optionally usable members wherein the basic device has spaced prongs on a carrier bar to handle logs for placing endwise into wood stoves. A transversely attachable device has spaced prongs to handle logs for feeding broadside into fireplaces. While the two combinations of elements could be permanently secured, versatility is effected by ready assembly or disassembly, depending upon the needs of users having a wood stove or a fireplace, or both. Thus, a person having only a wood stove need purchase only the basic device. A further embodiment has a permanent assembly convertible by a change in relative orientation of certain elements for feeding wood stoves or fireplaces. The same pair of spaced prongs for either function is utilized. All embodiments utilize a manual actuating linkage having a mechanical advantage for stressing a strong spacing wherein spring force is utilized for gripping the ends of a log between a pair of prongs. One prong is adjustable to effect an initial spacing between prongs approximating the length of a log.

20 Claims, 16 Drawing Figures

FIG. 1
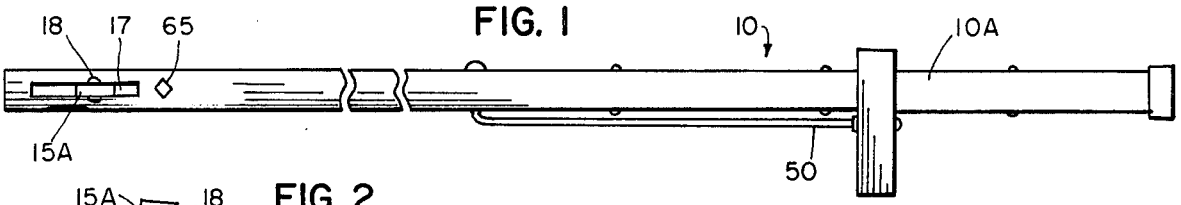
FIG. 2
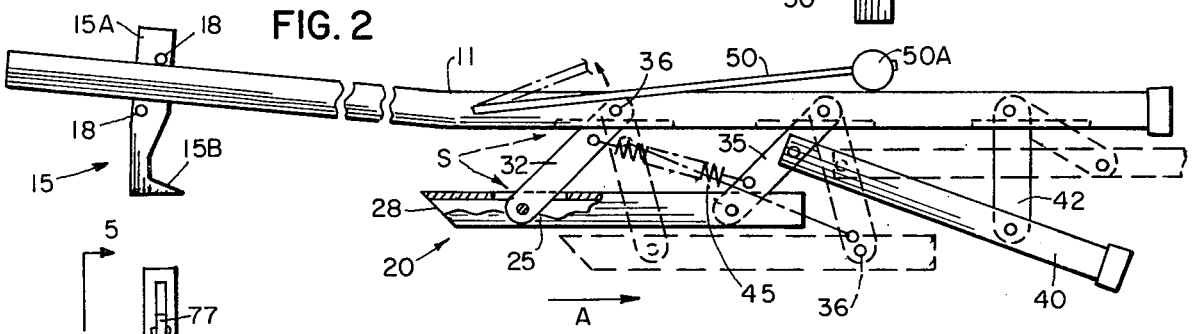
FIG. 3
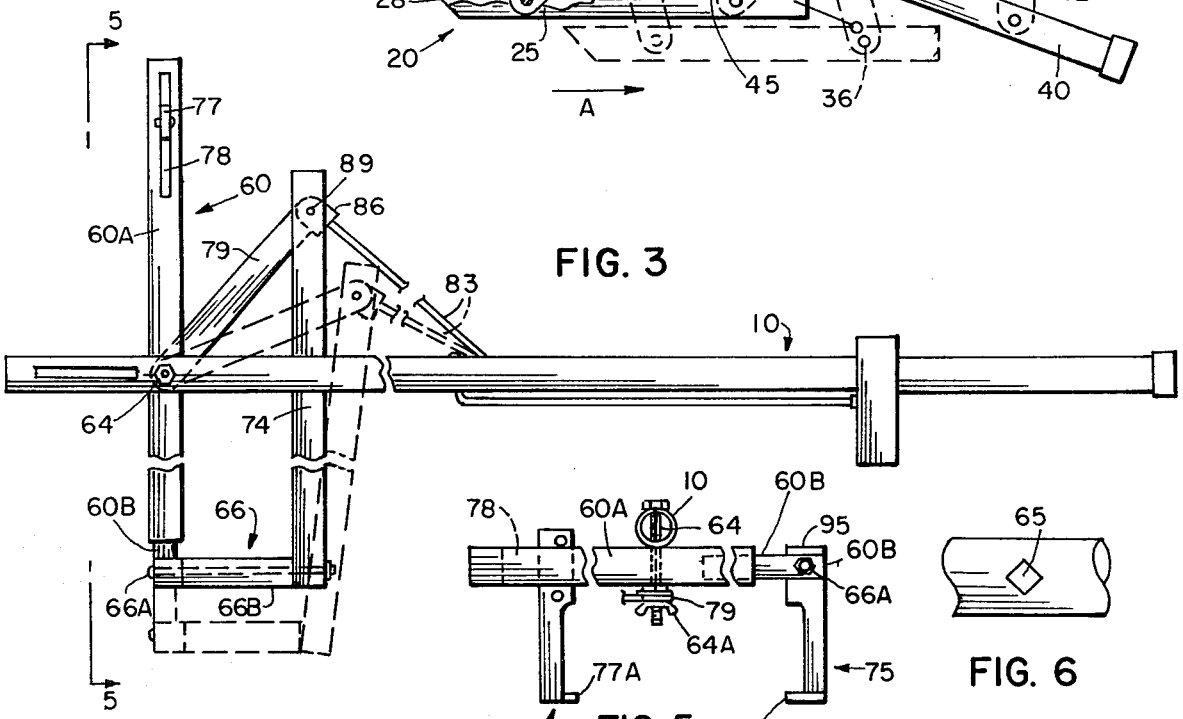
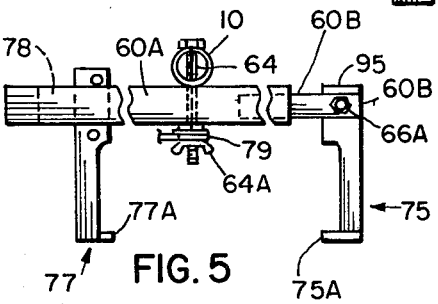
FIG. 5
FIG. 6
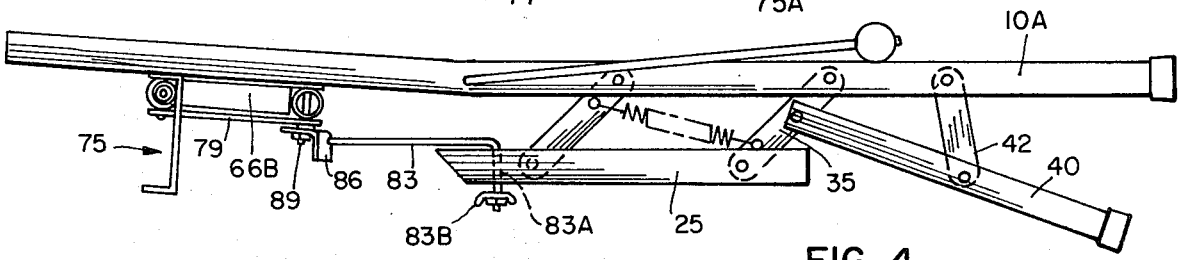
FIG. 4
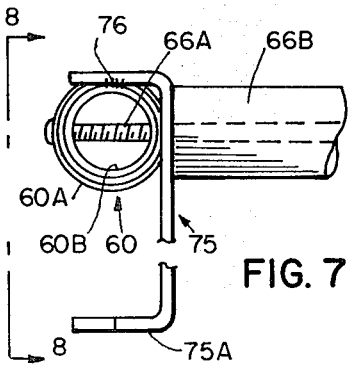
FIG. 7
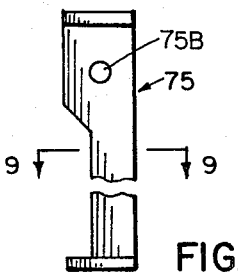
FIG. 8
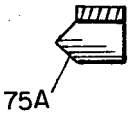
FIG. 9

WOOD STOVE AND FIREPLACE LOG HANDLER

BRIEF DESCRIPTION OF THE INVENTION

One embodiment comprises a lifting bar which can have a handle grip at one end, and which carries a manually actuatable prong mechanism. A longitudinally adjustable prong element is carried at the outer end of the lifting bar, which can be adjusted for different log lengths. The actuating mechanism is a polygonal linkage, in this case a quadrilateral linkage, wherein one of the links has a prong in general alignment with the prong at the outer end of the lifting bar. Such prong link is connected through a pair of links to the lifting bar and thus can move relative thereto to straddle the ends of a log in the spacing between the prongs.

A spring means is suitably disposed which biases the prong link to diminish the spacing between prongs and thus the force of the spring is utilized to effect digging in of the prongs at the ends of a log. An actuating lever is provided to operate the prong link against the bias of the spring to increase the spacing, placing the prongs in readiness to engage the ends of a log. Upon release of the actuating lever, which is in proximity to the lifting bar and to be hand squeezed therewith, the prong link moves forward under spring bias into gripping engagement with the end of a log, the other end of which is gripped by the prong member at the outer end of the lifting bar. Mechanical advantage is effected.

The preceding description is for placing logs endwise into a wood stove. For ease of handling, a tension rod or cable having a handle is attached approximately midway of the lifting bar extending toward to the user so that heavy logs can be readily handled with one hand on the lifting bar handle and the other hand holding the tension rod or cable.

Such tension rod or cable is also a safety feature to keep a person's hand away from open flame.

When it is desired to utilize the invention for placing logs broadside into fireplaces, an attachment may be assembled to the above described combination consisting of a pair of parallel members, one of which is a telescopic carrier bar for the prongs to be attached to the lifting bar described above and transversely thereof. The spacing between the prongs is opened by the same manipulation of the actuating lever via a tension rod. The same spring means is utilized for gripping bias.

A further embodiment of the invention combines the features of fireplace and wood stove feeding in a single embodiment convertible without disassembly for either function.

In all instances a log is gripped at one end by a prong which is initially adjusted relative the spring actuated prong to a distance approximate the log length. In all instances the mechanism uses pivotally related links to minimize friction and take advantage of leverage for mechanical advantage so that a strong spring can be used to effect gripping of logs, thus ensuring carrying safety which is not dependent on sustained human effort to maintain a gripping force while transporting a log from a log pile to stove or fireplace. Since such logs usually are of the order of 18"-22" in length and 3"-6" in diameter the weights involved can readily tax human strength in a sustained effort, whereas the stressing of a spring via leverage is a matter of a few seconds in holding the prongs spaced to grip a log. In all instances a pivotal handle leverage system converts a reciprocal mechanism for moving logs into wood stove or fireplace.

A detailed description of the invention now follows in conjunction with the appended drawing in which:

FIG. 1 is a plan view of the basic device for handling logs to be placed in a wood stove;

FIG. 2 is a side view of FIG. 1;

FIG. 3 is a plan view showing the log handler of FIG. 1 with an attachment for placing logs in a fireplace;

FIG. 4 is a side view of FIG. 3;

FIG. 5 is an end view as seen in the direction of arrows 5—5 of FIG. 3;

FIG. 6 is an enlarged plan view detail of FIG. 5;

FIG. 7 is an enlarged end view detail of FIG. 4;

FIG. 8 is a view of a prong bar member as seen in the direction of the arrows 8—8 of FIG. 7;

FIG. 9 is section on the section line 9—9 of FIG. 8.

Figures 10, 10A, 10B, 11, 12, 13, 14:
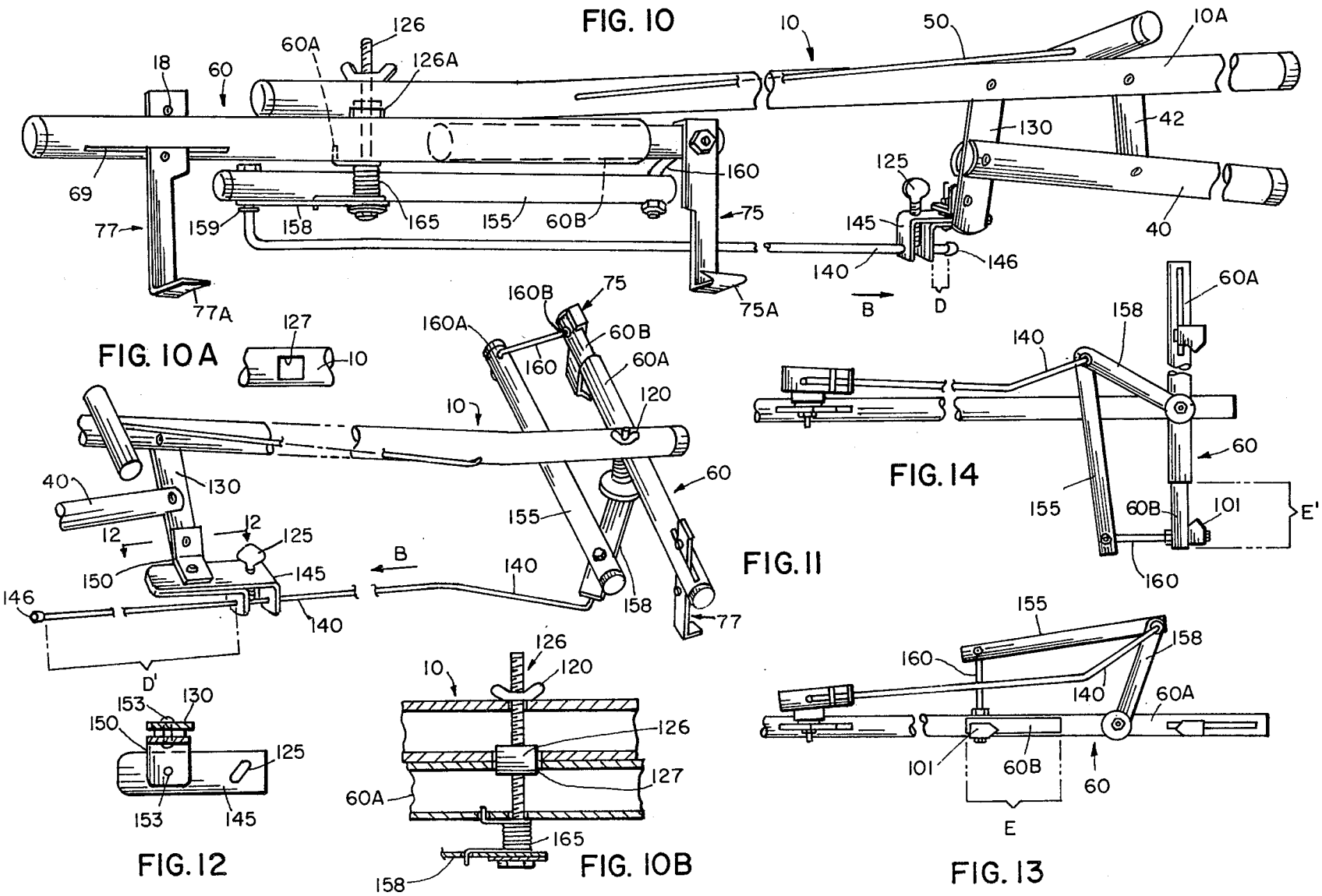
FIG. 10 shows in perspective an embodiment for convertibility without disassembly for feeding either a fireplace or a wood stove, wherein the parts arrangement in FIG. 10 effect wood stove feeding.
FIG. 10A shows a plan view detail of FIG. 10 longitudinally.
FIG. 10B shows a partial section detail of FIG. 10.
FIG. 11 shows in perspective the elements of FIG. 10 arranged for fireplace feeding.
FIG. 12 shows a partial section detail of FIG. 11 on line 12—12.
FIG. 13 is a bottom plan view of FIG. 10 illustrating the actuated position.
FIG. 14 is a bottom plan view of FIG. 11 illustrating the actuated position.

FIG. 1 shows a tubular lifting bar member 10 having handle member or lever 10A, preferably with a bend 11 as shown in FIG. 2 for large log diameter handling. Member 10 carries a slidably adjustable first log gripper prong means 15 comprising a tubular prong bar member 15A having a prong 15B. The prong bar or member 15A is carried in elongated aligned slots 17 through the top and bottom of member 10 and is provided with locking pins 18 straddling bar 10 and so spaced that they can lock member 15A to bar 10 after sliding it to an initial adjusted position in the slots 17. The prong 15B is pressed into one end of a log by thrust force on the other end of the log subsequent to log length adjustment.

A second log gripping prong means 20 comprises a tubular prong member 25 having an end shaped to effect a prong 28. The member 25 is the prong link of a polygonal linkage comprising a portion of bar 10 between the connective links 32 and 35, having respective ends received in lower and upper slots S of member 10 and 25 all pivotally connected as by rivets 36 or the like as shown in FIG. 1. In this instance a parallelogram quadilaterial linkage is shown, but no two links need be parallel. Links 32 and 35 serve to hold prong link 25 to the lifting bar member 10. A tubular operating or actuating lever 40 to operate the linkage may be in the form of a handle and is end slotted to pivotally receive the link 35 and top slotted to receive a pivotal guiding link 42 connected pivotally in a slot in the underside of the bar member 10, effecting a second polygonal quadulateral linkage comprising members 10, 35, 40 and 42. A spring means holds the mechanism with the prongs biased to a spacing depending on the adjusted position of the prong bars, e.g., spring 45 which urges prong 28 towards prong 15B which is initially adjusted for a particular log length. Spring 45 is a tension spring.

Other types of springs acting on pivotally connected components can be effective.

The connective links 32 and 35 are of predetermined length so that full vertical translation of prong link 25 will not position prong 28 beyond a point where it cannot coact with prong 15B in gripping opposite ends of a log even though the prongs may be misaligned dependent on the diameter of log being handled.

If the members 10 and 40 are squeezed together, the operation of the linkage will effect an increased prong spacing as shown in dashed lines, the prongs 15B and 28 having increased spacing, link 25 having moved in the direction of the arrow A to the fight as seen in FIG. 1. This increase of spacing stretches the spring 45 connected diagonally across the linkage between link members 32 and 35. The spring, in this case a biasing tension spring, is so disposed that it can force the link member 25 and thus the prong 28 to a decreased spacing relative the prong member 15B upon release of actuating member 40, whereupon a log can be gripped by spring tension between the prongs.

Thus, for variation in log lengths, prong bar 15A can be readily slid in slots 17 to proper position approximating a log length to be lifted and with the prongs then straddling respective ends of the log, with prong link 25 retracted, release of member 40 permits the spring to operate the linkage for impaling of the prongs into the log ends. Thereafter, the bar 10 can be lifted, preferably with the aid of a tension rod or cable 50 attached at some point along the length of the bar 10 and having a handle 50A. Thus, the user can grasp that handle and the lifting bar handle to use both hands for lifting a log and thrusting it into a wood stove, member 50 swinging up to give lifting aid as indicated by the arrow and also serving to keep the user's hand out of the wood stove.

FIGS. 3 through 9 show the same embodiment of FIGS. 1 and 2, as indicated by use of the same reference numerals, except that carried below the lifting bar 10 is a separable and attachable prong carring telescopic carrier bar 60 comprising tubular bar section 60A within which with a loose fit is reciprocal tubular bar section 60B, somewhat foreshortened as indicated in FIG. 5.

Carrier bar 60 is secured by a fastening 64 through bar section 60A to the lifting bar 10. The fastening 64 is square in section or otherwise shaped to key bar 60A at right angles to lifting bar 10 (FIGS. 5 and 6) so as to lock in the position shown in FIG. 3. The fastening 64 passes through square holes 65 (FIG. 6) in the bars 10 and 60A and is threaded at its lower end for a wing nut 64A for which a jam nut may be used if desired. The linkage mechanism of the attachable device is carried by the telescopic carrier bar section 60A and thus secured by the fastening 64 and wing nut 64A for ready attachment or detachment to lifting bar 10 at the underside thereof. Bar 60B is somewhat loosely carried with side play in bar 60A to effect a composite sliding link permitting slight pivotal action between these bar sections.

The looseness between bars 60A and 60B permits movement additionally to some flexibility inherent in a connection 66 for movement of link 74 from the solid to the dotted line positions of FIG. 3 shown somewhat exaggerated. However, a connection 160 could be pivotal with link 74 and rigid with bar 60B, e.g., as shown in FIGS. 10, 11, 13, 14 for link 160, later discussed.

Link connection 66 is established between bar section 60B and a link 74, having a throughbolt 66A with encompassing tubular spacer 66B secured by the throughbolt between bars 60B and 74.

As seen in FIGS. 5, 7–9 the throughbolt 66A secures a prong member 75 between the bar 60B and the end of spacer 66B, passing through an aperture 75B (FIG. 8) of the prong member which is bent and welded at 76 to bar 60B. Prong member 75 has a prong 75A formed at the lower bent end.

Bar 60 has a member 77 with prong 77A similar to the member 15, and carried in slots 78 similar to slots 17 and lockable in adjusted positions by pins similar to pins 18 as hereinabove explained for the basic device of FIGS. 1 and 2.

Tubular link 74 is pivotally carried at its other end by flat link 79 secured by fastening device 64 at the circular lower end and thus to bar section 60A (FIG. 5). The members 60A, 60B, 74 and 79 form a pivotal and sliding polygonal linkage movable from the solid line to the dashed line positions (FIG. 3) upon squeezing members 10A and 40 together. This is accomplished by a reciprocal drive rod 83 (FIG. 4) bent at 83A to pass through holes in prong link 25 and pivotal relative thereto. The portion 83A is threaded to take a wing nut 83B for ready attachment or detachment. Thus, rod 83 is a tension-compression operating member for the lever system or linkage which is an actuating means for the telescopic bar 60B to extend it. The portion 83A is slightly longer than the diameter of the prong link bar 25 to allow for rise and fall of that bar without binding unduly.

An angle 86 is rigidly secured to the rod 83 at its other end as by welding or the like to one side of the angle. The other angle side (FIG. 4) is pivotally connected to bar 74 along with link 79 by a pin or bolt 89, or a rivet.

In operation, a log can be gripped endwise between prongs 75A and 77A by squeezing the handle portion 10A and lever 40 to pull rod 83 thus driving link 74 to pull the bar section 60B into the extended position against the stress of spring 45, effecting gripping force at the ends of a log upon release of the handle members, i.e., portion 10A and lever 40. Thus, a log can be placed broadside into a fireplace. To release the log, the handle members are squeezed again and subsequently released.

When needed, the attachment for fireplace feeding is assembled to lifting bar 10 by wing nut 64A and wing nut 83B, or if not needed can be detached by removing the wing nuts. However, when attached, as seen in FIG. 3, the prong means 15 may be removed by providing for removability of the upper locking pin 18, e.g., as by a removable set screw or pin in place of a force fitted permanent pin.

FIG. 10 shows an embodiment wherein a single device incorporates the means for handling fireplace logs and wood stove logs, many elements heretofore present in FIGS. 1–9 being present and having the same reference numerals, new reference numerals being used for elements not present in FIGS. 1–9, or changed.

The log handler as shown in FIG. 10 is for wood stove logs while FIG. 11 shows the device converted for fireplace logs. An essential difference is that lifting bar 10 carries no prongs directly but carrier bar 60 (FIGS. 10, 11) comprised of telescopic bar sections 60A and 60B carries prongs 75A and 77A on members 75 and 77, respectively, all as shown in FIG. 5. Bar 60 can be aligned (FIG. 10) with bar 10 and clamped thereto by a wing nut 120 for wood stove feeding; or pivoted transversely (FIG. 11) by loosening the wing nut and a thumb screw 125, and retightening after bar 60 has been swung transversely to bar 10, in a manner hereinafter explained.

Wing nut 120 is on the elongated end of a threaded fastener 126 having an integral square section 126A which keys lockingly into square apertures 127 (FIGS. 10A, 10B) in bar 10 and bar section 60A as in the keying arrangements of FIG. 5. Thumb screw 125 locks an actuating rod to a link 130 as described below, in two selective positions.

In this instance link 130, somewhat larger than the link 32 of FIG. 2, clamps to an end of an actuating rod 140 by thumb screw 125 which is pulled in the direction of arrow B (FIGS. 10 and 11) when handle lever members 10A and 40 are squeezed together. The action is that of a polygonal linkage comprising links 10A, 40, 42 and 130 wherein a U-shaped clamp 145 is a holder for an end of rod 140, having bores through which the rod is slidable when thumb screw 125 is loosened, for an adjusted position of the rod.

Thus, the distance D (FIG. 10) from the outer leg of the holder clamp to the cap of the rod, i.e., cap 146,is a locked position of the rod 140 for wood stove feeding with bars 10 and 60 aligned. Distance D' (FIG. 11) is a locked position of rod 140 for fireplace feeding, with bar 60 transverse to bar 10.

A double pivoted arrangement connects rod 140 to link 130 via clamp 145. In this instance a simple right angle member 150 is pivotal (FIGS. 11 and 12) on rivets, such as 153, to the link and to the clamp.

The actuating rod 140 operates a mechanism for retracting prong 75A (FIG. 10) after prong bar 77 has been set to the approximate length of a log between prongs as heretofore explained in the use of the embodiments of FIGS. 1–9. Thus, rod 140 (FIGS. 10, 13, 14) connects pivotally at its other end with a link, e.g., tubular bar 155, and to a flat link 158, by being bent (FIGS. 10, 11) at its other end to pass through aligned apertures of the members 155 and 158 at one end of each, being headed in assembly and having a retainer ring 159 (FIG. 10). The other end of link 155 has a pivotal connection (FIG. 11). with a link 160 having one end 160A bent into diametrically aligned apertures of the tubular link 155. The other end 160B of link 160 is rigidly fastened to bar 60B, preferably passing through in an assembly welding or the like with bar 60B and with prong member 75.

A torsion spring 165 (FIGS. 10, 10B) encircles fastener 126, having one end secured in bar section 60A of bar 60 and the other end in link 158. The direction of bias is the same as for the spring 45 in FIGS. 1–9, i.e., forcing the prongs toward each other, whereby squeezing handle lever members 10A and 40 towards each other torsionally stresses the spring while widening the prong spacing by retracting the prong 75A. Upon handle member release,the prongs 75A and 77A are thrust into the log ends by spring force which forces prong 75A into one end of a log and gripping the log between the prongs.

Thus, FIG. 13 shows the extension E for section 60B for the wood stove feeding mode of FIG. 10, while FIG. 14 shows the extension E' for section 60B in the fireplace feeding mode.

In operation for wood stove feeding with bars 10 and 60 aligned (FIG. 10), after adjusting prong bar 77 to the approximate log length, squeezing the handle lever members pulls rod 140 via link 130, with link 42 as a fulcrum, to actuate the polygonal linkage (FIG. 13) 155, 158, 160, 60 to extend the inner telescopic section 60B a distance E against spring torsion. Release of the handle members permits the spring to reverse the direction and force the prong 75A into the log end, impinging the other end against the opposite prong 77A.

Spring 165 can be made very strong since the leverage is a matter of length of lever member handles 10A and 40.

To convert from FIG. 10 to FIG. 11 for fireplace feeding, the wing nut 120 is loosened so that the bar 60 drops down sufficiently to pull the square section 126 out of the square aperture 127 of bar 10 and the thumb screw 125 is loosened. Then, with handle lever members 10A and 40 held at the widest angle (FIG. 10),the bar 60 is swung to a transverse position relative to bar 10, swung clockwise as viewed in FIG. 11. Wing nut 125 and thumb screw 125 are then refastened.

For wood stove feeding the same action takes place, bar 60 being then swung counter-clockwise to align with bar 10 by loosening the wing nut and thumb screw 125, and refastening.

What is claimed is:

1. In a log handler having a lifting handle means (10A) and a carrier bar for a prong means comprising a pair of prongs spaced along said carrier bar at least one of which prongs is actuatable to grip a log end;

the improvement comprising:

an actuating mechanism having a spring means and including manually actuatable lever means at one end of said carrier bar affording a mechanical advantage for actuating said one prong to increase the spacing of said prongs to straddle the ends of a log while stressing said spring means;

whereby said prongs grip the ends of a log by force of said spring means upon release of said manually actuatable means and including means for initially spacing said prongs relative the length of a log to be handled prior to actuating said one prong.

2. In a log handler as set forth in claim 1, including a tension support member (50) connected to said carrier bar intermediate said prongs and effecting a handle means operative for transmitting manual pull to said carrier bar to assist in transporting said carrier bar with a log gripped between said prongs.

3. In a log handler as set forth in claim 2, wherein said lifting handle means is comprised in said manually actuatable lever means and said manually actuatable lever means having a manually actuatable lever with pivotal connection means to said carrier bar; said actuating mechanism comprising a polygonal linkage system for converting the relative pivotal movement of said manually actuatable lever to a prong thrust movement.

4. In a log handler as set forth in claim 2, wherein said lifting handle means is comprised in said manually actuatable lever means and said manually actuatable lever means having a manually actuatable lever with pivotal connection means to said carrier bar, said actuating mechanism comprising a quadrilateral linkage system for converting the relative pivotal movement of said manually actuatable lever to a prong thrust movement.

5. In a log handler as set forth in claim 2, said lifting handle means comprising a lever handle (10A) and said actuating mechanism comprising a lever handle having a pivotal connection with said first mentioned lever handle; said lever handles being spaced to be gripped with one hand and squeezed toward each other for actuating said one prong.

6. In a log handler as set forth in claim 1, wherein said lifting handle means is comprised in said manually actuatable lever means and said manually actuatable lever means having a manually actuated lever with pivotal connection means to said carrier bar; said actuating mechanism comprising a polygonal linkage system carried by said carrier bar and carrying said one prong and converting the relative pivotal movement of said manually actuatable lever to a prong thrust movement.

7. In a log handler as set forth in claim 6, said polygonal linkage system being a parallelogram linkage system wherein said carrier bar is one link thereof and said one prong is carried by a link parallel thereto and has translational motion relative thereto.

8. In a log handler as set forth in claim 7, and a tension member (50) connected to said carrier bar spaced from said lifting handle means to assist in lifting a log carried between said prongs by exerting a manual tension force thereof.

9. In a log handler as set forth in claim 7, said spring means being a tension spring extending across a pair of parallel links of said parallelogram linkage.

10. In a log handler as set forth in claim 7, said lifting handle means being extended to integrally form said carrier bar and a bend in said carrier bar to compensate for the translational motion of said one prong so as to closely align the thrust direction thereof with the other said prong.

11. In a log handler as set forth in claim 10, said spring means being a tension spring extending across a pair of parallel links of said parallelogram linkage.

12. In a log handler having a lifting handle means (10A) and a carrier bar for a prong means comprising a pair of prongs spaced along said carrier bar at least one of which prongs is actuatable to grip a log end;

the improvement comprising:

an actuating mechanism having a spring means and including manually actuatable lever means at one end of said carrier bar affording a mechanical advantage for actuating said one prong to increase the spacing of said prongs to straddle the ends of a log while stressing said spring means;

whereby said prongs grip the ends of a log by force of said spring means upon release of said manually actuatable means wherein said lifting handle means is comprised in said manually actuatable lever means; said manually actuatable lever means having a manually actuatable lever with pivotal connection means to said carrier bar; said actuating mechanism comprising a polygonal linkage system having at least four pivots carrying said one prong and converting the relative pivotal movement of said manually actuatable lever to a prong thrust movement.

13. In a log handler as set forth in claim 12, a second carrier bar carried transversely on said first mentioned carrier bar and carrying said prong means.

14. In a log handler as set forth in claim 12, including a guide link pivoted to said carrier bar and to said manually actuated lever means and being a link of said polygonal linkage system.

15. In a log handler as set forth in claim 14, said spring means being a tension spring having one end attached to said guide link.

16. In a log handler as set forth in claim 14, said lever (40), said handle means (10A), said guide link (42) and said link (35) of said polygonal linkage system forming a second polygonal linkage system.

17. In a log handler as set forth in claim 14, said polygonal linkage system being a parallelogram linkage wherein said prong (28) of said prong means (20) has translational movement relative to said carrier bar.

18. In a log handler having a lifting handling means (10A) and a carrier bar for a prong means comprising a pair of prongs spaced along said carrier bar at least one of which prongs is actuatable to grip a log end;

the improvement comprising:

an actuating mechanism having a spring means and including manually actuatable lever means affording a mechanical advantage for actuating said one prong to increase the spacing of said prongs to straddle the ends of a log while stressing said spring means;

whereby said prongs grip the ends of a log by force of said spring means upon release of said manually actuatable means including a second carrier bar (60) supported transversely on said first mentioned carrier bar and having a second pair of spaced prongs (75A, 77A) at least one of which is actuatable;

a second mechanism carried by said second carrier bar for actuating said one prong and an actuating connection (83) from said second mechanism to said first mentioned mechanism for actuation of said second mechanism thereby wherein said spring means effects the force for gripping a log by the spaced prongs of said second carrier bar.

19. In a log handler as set forth in claim 18, including means whereby the other of said second pair of prongs is adjustable to initially vary the spacing between said second pair of prongs to approximate the length of a log to be handled prior to actuation of said one prong of said second pair of prongs.

20. In a log handler as set forth in claim 18, including attaching means for optionally attaching and detaching said second carrier bar and said second mechanism and said actuating connection to and from said first mentioned mechanism and means for holding said second carrier bar fixedly transversely to said first carrier bar.

* * * * *